United States Patent [19]

Kimura et al.

[11] Patent Number: 4,613,053

[45] Date of Patent: Sep. 23, 1986

[54] SOLID AND LIQUID GOODS TRANSPORTING CONTAINER

[75] Inventors: Tetsuro Kimura; Kohei Ide, both of Yokohama, Japan

[73] Assignee: Tokyu Sharyo Seizo Kabushiki Kaisha, Kanagawa, Japan

[21] Appl. No.: 765,367

[22] Filed: Aug. 13, 1985

[30] Foreign Application Priority Data

Aug. 14, 1984 [JP] Japan ..... 59-124098[U]

[51] Int. Cl.[4] ..... B65D 1/24; B65D 1/36; B65D 57/00

[52] U.S. Cl. ..... 220/22; 220/1.5; 220/85 B; 222/105; 222/183; 105/359

[58] Field of Search ..... 220/1.5, 22, 85 B; 222/105, 183; 105/359, 243, 239

[56] References Cited

U.S. PATENT DOCUMENTS

| | | | |
|---|---|---|---|
| 3,578,213 | 5/1971 | Clarke | 222/183 |
| 3,583,330 | 6/1971 | Freudman | 220/85 B |
| 3,756,469 | 9/1973 | Clark et al. | 222/105 |
| 4,557,400 | 12/1985 | Clarke | 220/1.5 |

*Primary Examiner*—George T. Hall
*Attorney, Agent, or Firm*—Murray Schaffer

[57] ABSTRACT

A liquid containing bag is mounted on the upper surface of the floor of a box-shaped container and is provided with an inlet port and outlet port opening outside the container and a protective partition forming a space for housing the above mentioned liquid containing bag when solid goods are to be transported is provided in the lower corner on the front end panel side of the container.

8 Claims, 13 Drawing Figures

SOLID AND LIQUID GOODS TRANSPORTING CONTAINER

FIELD OF THE INVENTION

This invention relates to a solid and liquid goods transporting container which can transport solid or liquid goods as required in the going trip and returning trip or vice versa.

That is to say, for example, in the going trip, such solid goods as sundries, boxed goods and bagged goods can be transported and, in the returning trip, liquid goods can be transported. Thus, the container can be efficiently used and is economical.

By the way, the container of the present invention can be effectively applied also as fixed in advance to a truck or a so-called van.

BACKGROUND OF THE INVENTION

There have been generally used a dry container to transport such solid goods as are mentioned above and an exclusive container or vessel to transport liquid goods.

Therefore, there have been defects that, for example, when solid goods are transported in the going trip, in case there are no goods of the same kind in the returning trip, the container will be vacant and will be very uneconomical and, in case there are liquid goods in the returning trip, the solid goods container will not be able to meet the requirement.

BRIEF SUMMARY OF THE INVENTION

The present invention has it as an object to provide a solid and liquid goods transporting container which can transport solid or liquid goods as required in the going trip and returning trip or vice versa.

Therefore, in the present invention, a liquid containing bag is mounted on the upper surface of the floor of a box-shaped container and is provided with an inlet port and outlet port opening outside the container and a protective partition forming a space for housing the above mentioned liquid containing bag when solid goods are to be transported is provided in the lower corner on the front end panel side of the container.

According to the present invention of the above mentioned formation, when solid goods are to be transported, the liquid goods and air within the liquid containing bag are taken out. The liquid containing bag having become sheet-shaped as a result is compactly rolled or folded from the opening and closing door side of the container, is positioned in the lower corner on the front end panel side and is housed in a housing space formed by a protective partition.

Thus, solid goods can be contained in the entire interior of the container except the above mentioned housing space.

Next, in the case of transporting liquid goods, the liquid containing bag is developed on the entire floor, the liquid goods are poured in through the inlet port to inflate the liquid containing bag.

As in the above, according to the present invention, as solid or liquid goods can be transported as required, the container has advantages that it can be efficiently used and is econimical.

BRIEF DESCRIPTION OF THE DRAWINGS

FIG. 9 is an elevation showing liquid goods as being transported.

FIG. 10 is an elevation showing solid goods as being transported.

FIG. 11 is a sectioned view on line D—D in FIG. 9 with a part omitted.

FIG. 12 is an elevation showing liquid goods as being transported with a part omitted.

FIG. 13 is an elevation showing solid goods as being transported with a part omitted.

DETAILED DESCRIPTION OF THE INVENTION

Figure 1:
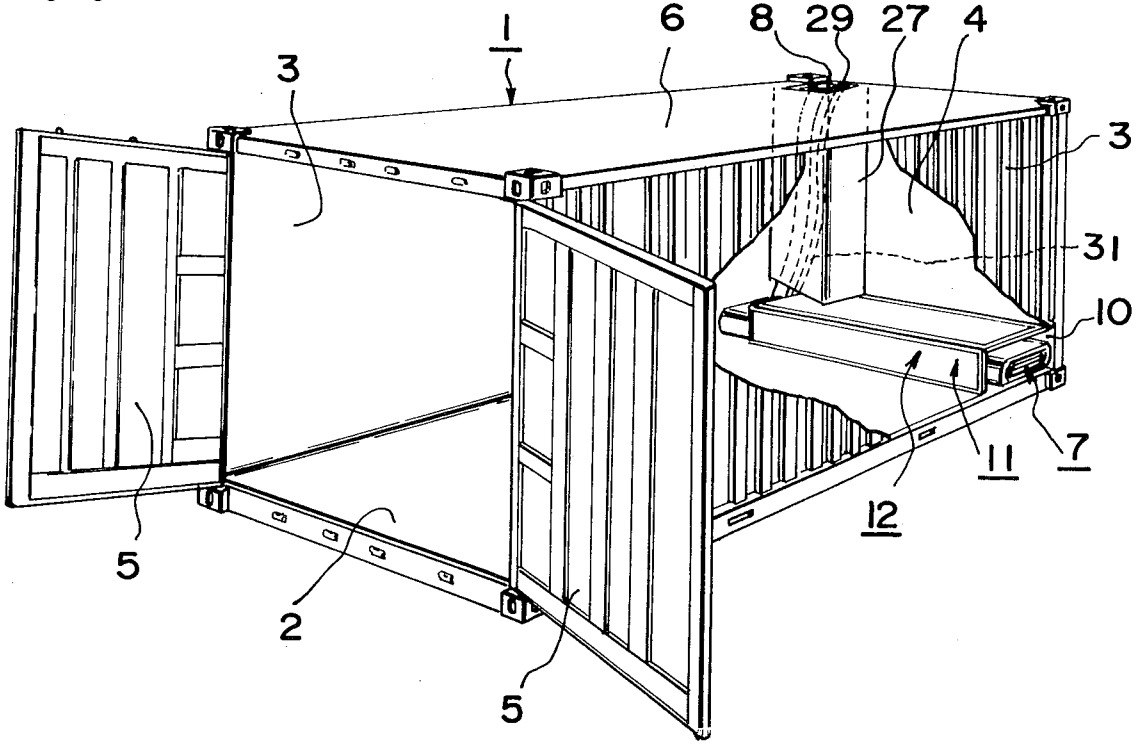
FIG. 1 is a partly sectioned general perspective view.

The fundamental formation of the present invention shall be explained with reference to FIGS. 1 and 2.

In the drawings, the reference numeral 1 represents a box-shaped container formed of side panels 3 erected on both sides of a floor 2, a front end panel 4 provided at one end of the floor 2, an opening and closing door 5 provided at the other end of the floor 2 and a roof panel 6 provided above them.

By the way, it is preferable to form the above mentioned side panels 3, front end panel 4 and opening and closing door 5 of corrugated panels so as not to be flexed by the liquid pressure when containing liquid goods.

However, needless to say, if a proper reinforcement is applied, flat panels will do.

Further, in the present invention, a liquid containing bag 7 is mounted on the upper surface of the floor 2 and is provided with an inlet port 8 and outlet port 9 opening outside the above mentioned container 1. Also, there is provided a protective partition 11 forming a space 10 for housing the above mentioned liquid containing bag 7 in the lower corner on the front end panel 4 side when transporting solid goods.

According to the present invention of the above mentioned formation, when solid goods are to be transported, the liquid goods and air within the liquid containing bag 7 are taken out. The liquid containing bag 7 having become sheet-shaped is compactly rolled or folded from the opening and closing door 5 side, is positioned in the lower corner of the front end panel 4 and is housed as shown in FIG. 1 within the housing space 10 formed by the protective partition 11.

Thus, solid goods 32 can be contained in the entire interior of the container 1 except the above mentioned housing space 10.

Figure 2:
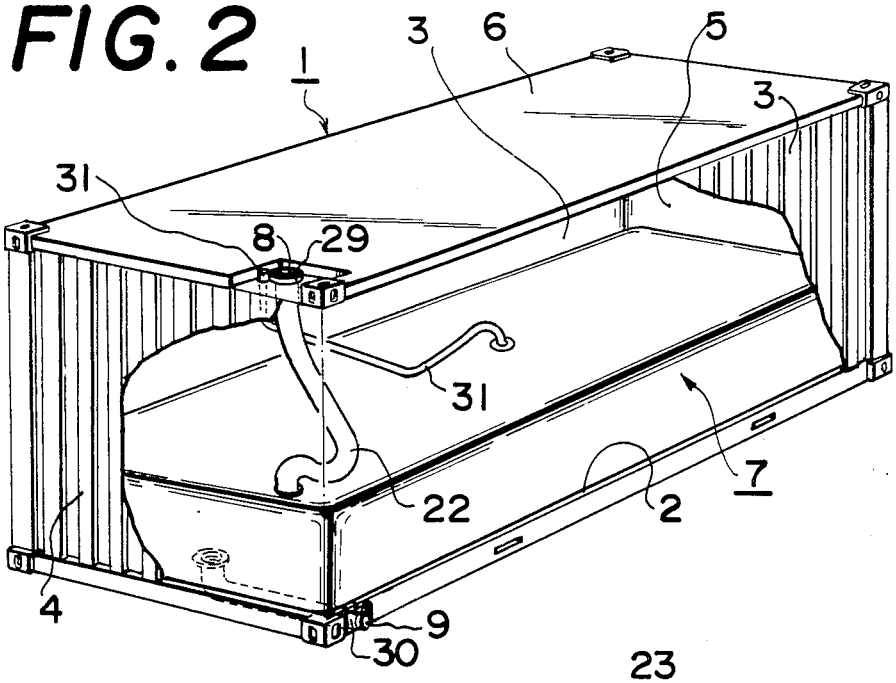
FIG. 2 is a partly sectioned general perspective view as seen from the other side of FIG. 1.

Next, in the case of transporting liquid goods, the liquid containing bag 7 is developed on the entire floor 2, the liquid goods 33 are poured in through the inlet port 8 and the liquid containing bag 7 is inflated as shown in FIG. 2.

As in the above, according to the present invention, as solid or liquid goods can be transported as required, there are advantages that the container can be efficiently used and is economical.

A concrete embodiment of the present invention shall be explained in detail in the following. In this explanation, the same reference numerals are attached to the same component parts as in the above mentioned explanation.

FIGS. 1 to 8 show an embodiment of the present invention.

Figure 3:
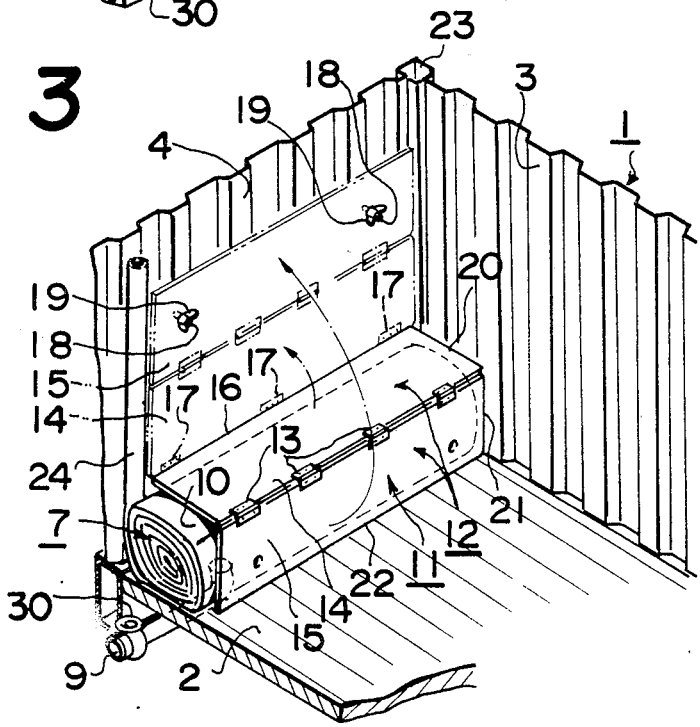
FIG. 3 is a magnified perspective view of an essential part.

In this embodiment, the protective partition 11 is a two-folded plate 12 closely contactable with the inside surface of the container 1. As shown in FIG. 3, the two-folded plate 12 is formed of plates 14 and 15 jointed with each other through hinges 13. Further, the plate 14 is jointed with the front end panel 4 through hinges 17 along the end 16 on the other side of the above mentioned hinges 13 so that the two-folded plate 12 may be closely contactable with the inside surface of the front end panel and, when the plates 14 and 15 are folded to be inverted L-shaped, a rectangular parallelepiped-shaped housing space 10 may be formed in the lower corner on the front end panel 4 side. In FIG. 3, the reference numeral 18 represents a two-folded plate 12 fitting bolt provided in a proper position of the front end panel 4, fitted with a hole provided in a proper position of the plate 15 and screwed with a wind nut 19 to closely contact the two-folded plate 12 with the front end panel 4.

By the way, in FIG. 3, the plate 14 is jointed along the end 16 with the front end panel 4 through the hinges 17 but alternatively the plate 14 or 15 may be jointed respectively along the end 20 or 21 with the side panel 3 through the hinges 17 or the plate 15 may be jointed along the end 22 with the floor 2 through the hinges 17 and a projection for mounting the plate 14 may be provided in a proper position of the front end panel 4.

Also, in the above mentioned embodiment, an inlet hose 24 is provided along a corner pillar 23 on the front end panel 4 side to open on the upper outside of the container 1. The inlet port 8 is made the opening of the inlet hose 24. By the way, the above mentioned inlet hose 24 is of a flexible hose connected to the upper surface of the liquid containing bag 7 so as to flex as shown in FIGS. 2, 7 and 8 when liquid goods are transported and to be along the above mentioned corner pillar 23 as shown in FIGS. 1, 4, 5 and 6 when solid goods are transported. Needless to say, if the above mentioned inlet hose 24 is connected, for example, to the underside of the liquid containing bag 7, it will not be always necessary to be a flexible hose. By the way, the above mentioned inlet hose 24 is not always required to be directly along the corner pillar 23 but may be provided near the corner pillar 23.

There is provided a hose protector 27 covering the above mentioned inlet hose 24, connected rotatably at one end to the lower surface of the roof panel 6 and having at the other end a locker 26 engaging with a receiver 25 provided in an upper proper position within the container.

Figure 6:
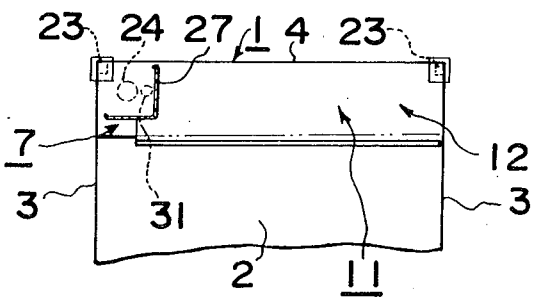
FIG. 6 is a sectioned view on line B—B in FIG. 5.
Figure 7:
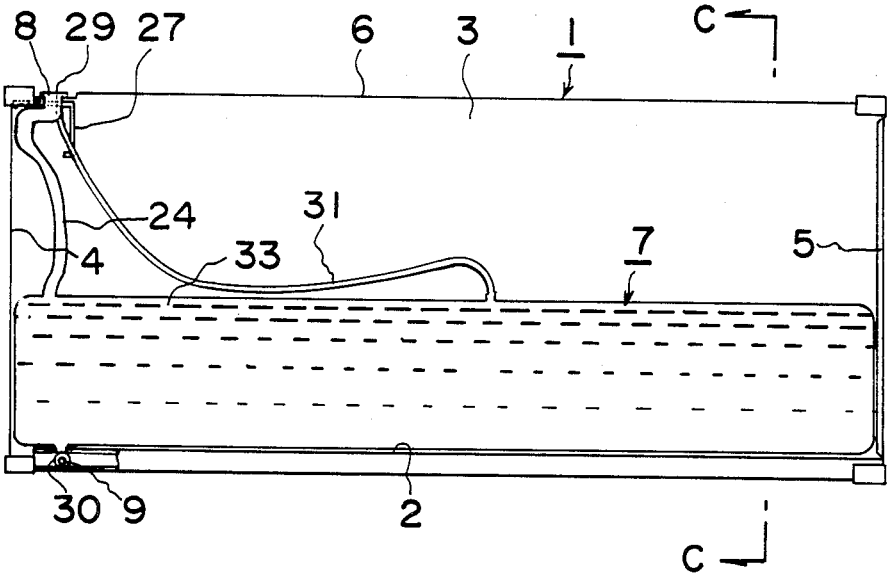
FIG. 7 is an elevation showing liquid goods as being transported.
Figure 8:
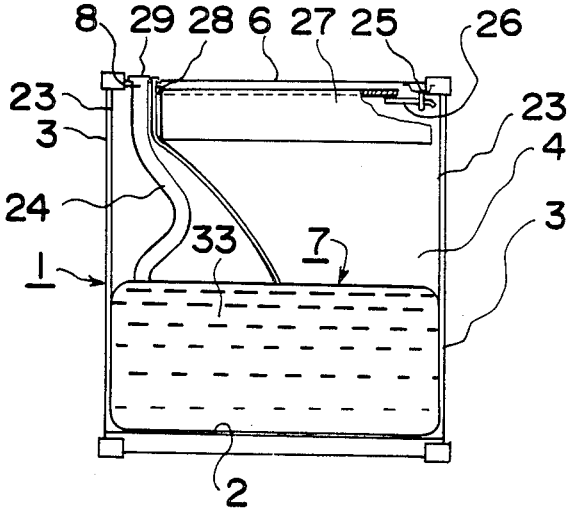
FIG. 8 is a sectioned view on line C—C in FIG. 7.

As shown in FIGS. 6 and 7, the hose protector 27 is formed to be substantially L-shaped in the cross-section and is rotatably connected at one end to the lower surface of the roof panel 6 through a hinge 28. Needless to say, the hose protector 27 need not be limited to be L-shaped in the cross-section and may only cover the inlet hose 24 when rotated upward. Therefore, for example, it may be arcuate or the like in the cross-section. The hose protector 27 is made rotatable in the plane parallel with the front end panel 4 but may be made rotatable in the plane parallel, for example, with the side panel by changing the hinge 28 fitting position.

The locker 26 provided at the other end of the hose protector 27 is a pin made to engage with the receiver 25 formed to be ring-shaped on the lower surface of the roof panel 6. By the way, it is preferable that, when the hose protector 27 is rotated upward, the above mentioned locker 26 and receiver 25 will be automatically engaged with each other. Also, when the hose protector 27 is rotated upward, the above mentioned locker 26 and receiver 25 may be held below the roof panel 6. As regards their fitting positions, for example, the receiver 25 fitting position may be properly changed to be above the side panel 3.

By the way, in the above mentioned embodiment, the inlet port 8 is provided with a cap 29 and the outlet port 9 is provided with an opening and closing valve 30. Further, the reference numeral 31 represents an air venting hose provided as required and opened on the upper outside of the container 1. The air venting hose 31 is of a flexible hose so that, in the case of transporting solid goods 32, the hose may be rolled together with the liquid containing bag 7 and the rising part may be covered with the protector 27 together with the inlet hose 24.

According to the above mentioned embodiment, in the case of transporting solid goods 32, when the opening and closing valve 30 is opened, the liquid within the liquid containing bag 7 is discharged through the outlet port 9 and further the remaining air is also discharged, the liquid containing bag 7 will contract to be sheet-shaped on the floor 2.

Figure 4:
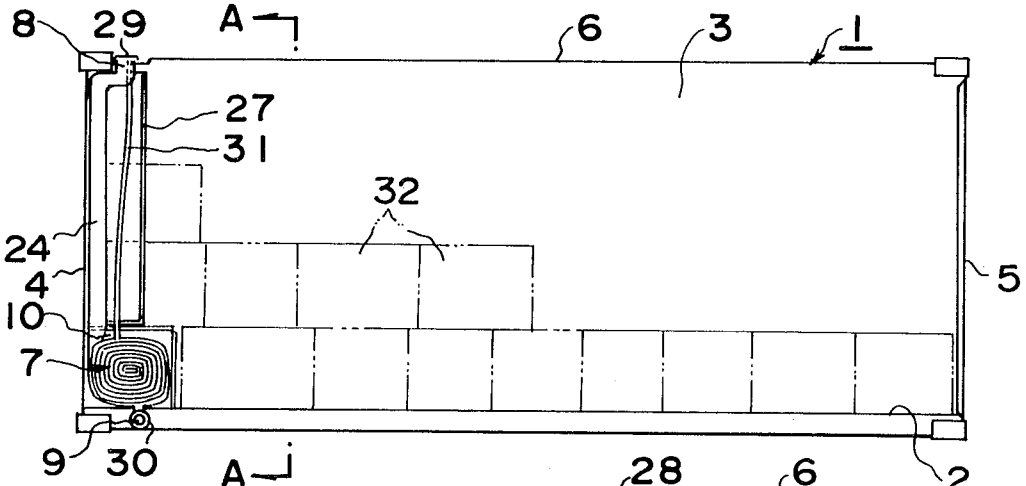
FIG. 4 is an elevation showing solid goods as being transported.
Figure 5:
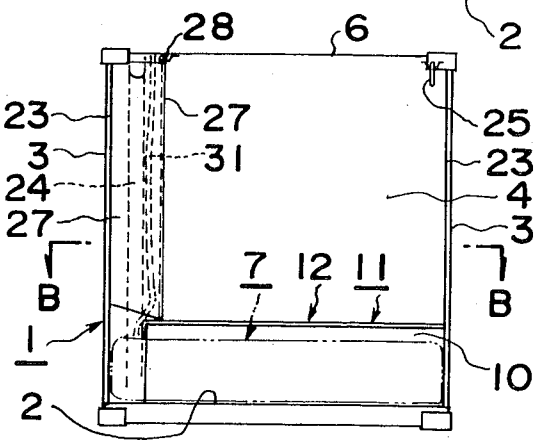
FIG. 5 is a sectioned view on line A—A in FIG. 4.

Then, the liquid containing bag 7 having contracted to be sheet-shaped is compactly rolled from the opening and closing door 5 side and is positioned in the lower corner of the front end panel 4 and, as shown in FIGS. 1, 3 and 4, the two-folded plate 12 is folded to be inverted L-shaped to cover the liquid containing bag 7.

As a result, the rolled liquid containing bag 7 will be covered with the two-folded plate 12 and the liquid containing bag 7 will be housed within the housing space 10.

Further, the locker 26 provided at the other end of the hose protector 27 will be released from the receiver 25 provided in an upper proper position within the container 1, the hose protector 27 will be rotated downward and will cover the inlet hose 24 opening on the upper outside as laid along the corner pillar 23 on the front end panel 4 side.

As in the above, as shown in FIGS. 1 and 4, a space for containing the solid goods 32 will be formed within the container 1 so that the solid goods 32 may be contained and transported. The inlet hose 24 will be covered and protected by the hose protector 27 so as not to be likely to be damaged during the transportation of the solid goods 32. The solid goods 32 can be contained in such close contact with the hose protector 27 as not to be likely to be collapsed or damaged during the transportation.

In the case of transporting liquid goods 33, reversely to the transportation of the above mentioned solid goods, the hose protector 27 is rotated upward and, as shown in FIG. 8, the locker 26 provided at the other end of the hose protector 27 is locked by the receiver 25 provided in an upper proper position within the container 1.

As a result, the hose protector 27 will be held below the roof panel 6 where a dead space will be formed when the liquid goods 33 are to be transported. Thus, not only the transportation of the liquid goods 33 will not be obstructed but also any special space for housing the protector 27 will not be required to be formed.

As shown by the imaginary lines in FIG. 3, the two-folded plate 12 is in close contact with the inside surface of the front end panel 4 and is fixed with the fixing bolt 18 and wind nut 19 and the liquid containing bag 7 is developed on the entire floor 2. When the liquid goods 33 are poured into the bag 7 through the inlet port 8, as shown in FIGS. 2, 7 and 8, the liquid containing bag 7 will be charged with the liquid goods 33 and will be inflated.

As in the above, in the above mentioned embodiment, as the protective partition 11 consists of the two-folded plate 12, there are advantages that, in the case of transporting the solid goods 32, the protective partition 11 will be convenient to handle and the space within the container 1 will be able to be effectively utilized. In case the inlet hose 24 made of a flexible hose is provided, if there is no hose protector 27, in the case of trnasporting the solid goods 32, the goods will not be able to be placed near the inlet hose 24 and will collapse during the transportation and both of the above mentioned inlet hose and solid goods will be likely to be damaged. However, in the above mentioned embodiment, as the hose protector 27 is provided, there is an advantage that the above mentioned damage can be prevented.

By the way, making the protective partition 11 of the two-folded plate 12 and providing the hose protector have respectively the above mentioned independent advantages and, therefore, it is evident that they may be worked respectively independently.

Figure 9:
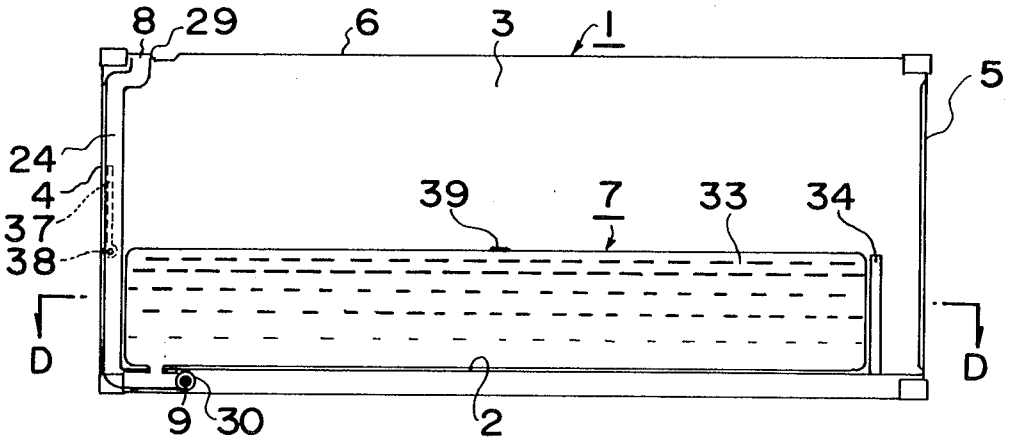
FIGS. 9 to 11 show another embodiment.
Figure 10:
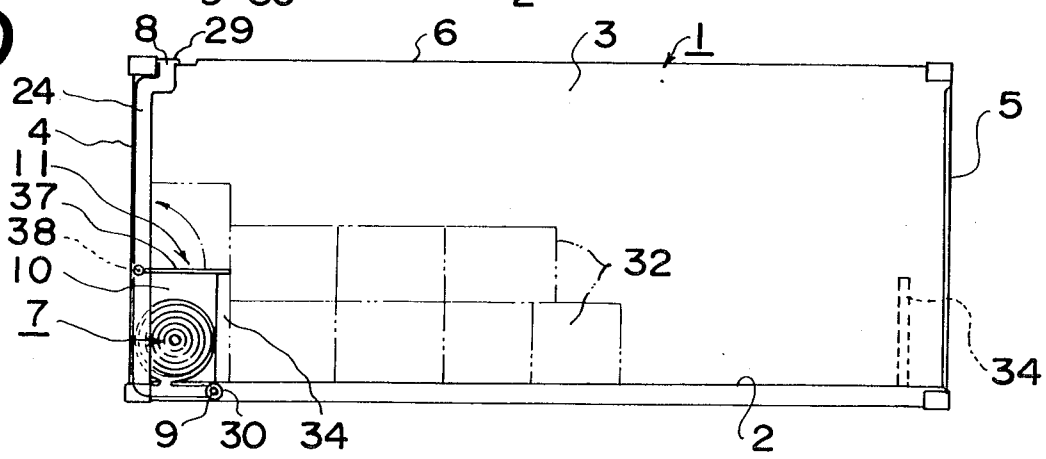
Figure 11:
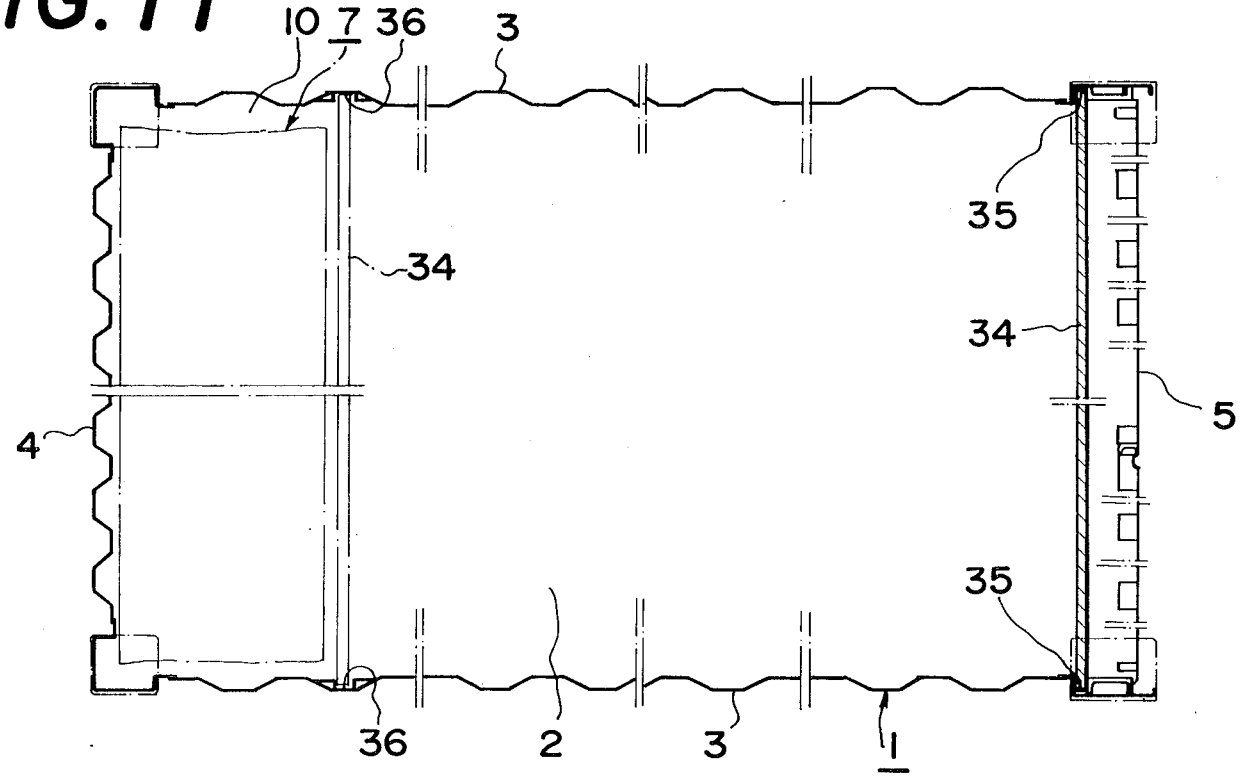

FIGS. 9 to 11 show another embodiment of the present invention. By the way, the same reference numerals are attached to the same component parts as of the above mentioned embodiment.

In a box-shaped container, a removable load collapse preventing plate 34 is provided on the opening and closing door 5 side on the floor 2. That is to say, a fixing part 35 for the load collapse preventing plate 34 is formed in a proper position on the opening and closing door 5 side and the load collapse preventing plate 34 is erected and fixed on the opening and closing door 5 side on the floor 2. By the way, as shown in FIG. 11, the above mentioned fixing part 35 is made a guide groove formed in each side panel 3. The load collapse preventing plate 34 is removably fitted from above in the guide groove. However, the above mentioned fixing part 35 is not limited to be the guide groove but may be any other fixing means.

Further, in the above mentioned embodiment, a fixing part 36 for the load collapse preventing plate 34 is formed in a proper position on the front end panel 4 side within the container 1 and the protective partition 11 is formed of the above mentioned load collapse preventing plate 34 moved and fixed to the above mentioned fixing part 36 and a plate 37 provided closely contactably with the inside surface of the container 1. To explain concretely, the fixing part 36 in a proper position on the above mentioned front end panel 4 side the same as the fixing part 35 in a proper position on the above mentioned opening and closing door 5 side is made a guide groove formed in each side panel 3 as shown in FIG. 11. The load collapse preventing plate 34 is removably fitted from above in the guide groove. Also, the plate 37 is fitted to the front end panel 4 through a hinge 38 so as to be closely contactable with the the inside surface of the front end panel 4 and to form a rectangular parallelepiped-shaped housing space 10 in the lower corner on the front end panel 4 side when rotated and mounted above the load collapse preventing plate 34 moved and fixed to the above mentioned fixing part 36. By the way, the above mentioned plate 37 is fitted to the front end panel 4 through the hinge 38 but may be fitted to the side panel 3.

By the way, in the above mentioned embodiment, as shown in FIGS. 9 and 10, the inlet hose 24 is connected to the underside of the liquid containing bag 7 and its connection is in common with the outlet port 9 so as to reduce the holing work and sealing work on the liquid containing bag 7. The reference numeral 39 represents an air venting valve provided as required and provided instead of the air venting hose 31 in the embodiment shown in FIGS. 1 to 8.

According to the above mentioned embodiment, in the case of transporting the liquid goods 33, the plate 37 is brought into close contact with the inside surface of the front end panel 4. The load collapse preventing plate 34 is erected as fixed to the fixing part 35 on the opening and closing door 5 side. Further, the liquid containing bag 7 is developed on the entire floor 2. When the liquid goods 33 are poured into the bag 7 through the inlet port 8, the liquid containing bag 7 will be charged with the liquid goods 33 and will be inflated. As a result, as shown in FIG. 9, the load collapse preventing plate 34 will be positioned on the opening and closing door 5 side of the inflated liquid containing bag 7 so that the load collapse preventing plate 34 may protect the opening and closing door 5 side from projections inside the opening and closing door 5 and may protect the opening and closing door 5 from the pressure of the liquid containing bag 7 produced during the transportation.

In the case of transporting the solid goods 32, when the opening and closing valve 30 is opened, the liquid goods 33 within the liquid containing bag 7 are discharged through the outlet port 9 and further the remaining air is also discharged, the liquid containing bag 7 will contract to be sheet-shaped on the floor 2.

Then, the liquid containing bag 7 having contracted to be sheet-shaped is compactly rolled from the opening and closing door 5 side and is positioned in the lower corner on the front end panel 4 side. As shown in FIG. 10, the load collapse preventing plate 34 is moved and fixed to the fixing part 36 on the front end panel 4 side and the plate 37 may be mounted above the load collapse preventing plate 34.

As a result, the rolled liquid containing bag 7 will be covered with the load collapse preventing plate 34 and the plate 37 and will be protected and housed within the housing space 10.

When the liquid containing bag 7 is housed as mentioned above, a space for containing the solid goods 32 will be formed within the container 1 as shown in FIG. 10 and the solid goods 32 will be able to be contained and transported.

By the way, according to the above mentioned embodiment, even in the case of taking out the solid goods 32, not only the load collapse preventing plate 34 will not be in the way but also no special space for housing the load collapse preventing plate 34 is required to be formed within the container and therefore no dead space will be produced within the container. Further, as the plate 37 may be only a plate fitted through the hinge, the structure will be simple.

As in the above, in the above mentioned embodiment, as the removable load collapse preventing plate 34 is provided on the opening and closing door 5 side on the floor 2, there are advantages that, in the case of transporting the liquid goods 33, the liquid containing bag 7 inflated by the contained liquid goods 33 can be prevented on the opening and closing door 5 side from being damaged by the contact with projections inside the opening and closing door 5 and further the opening and closing door 5 can be protected by preventing the liquid goods 33 producing an inertia force during the transportation or directly the liquid containing bag 7 from applying a pressure to the opening and closing door 5.

Needless to say, instead of using the above mentioned load collapse preventing plate 34, the opening and closing door 5 may be reinforced and may be formed inside to be sheet-shaped without projections. However, in such case, the structure of the opening and closing door 5 will be so complicated as to increase the cost. Therefore, it is preferable to use the load collapse preventing plate 34.

By the way, even in the embodiment shown in FIGS. 1 to 8, the load collapse preventing plate 34 can be provided on the opening and closing door 5 side on the floor 2.

Further, as already described, in the above mentioned embodiment, as the protective partition 11 consists of the load collapse preventing plate 34 to be moved and fixed and the plate 37 provided in advance, there are advantages that no trouble is required to handle the load collapse preventing plate 34, no dead space is provided within the container 1 and further the protective partition 11 is simple in the formation.

That is to say, if the removable load collapse preventing plate 34 is provided on the opening and closing door 5 side on the floor 2 and the protective partition 11 is made of another formation, for example, of the two-folded plate 12 in the embodiment shown in FIGS. 1 to 8, in the case of transporting the solid goods 32, the above mentioned load collapse preventing plate 34 will be removed, the solid goods 32 will be carried into the container 1 and the load collapse preventing plate 34 will not be required but will be erected on the opening and closing door 5 side on the floor 2 the same as in transporting the liquid goods 33 even after the solid goods 32 are carried in unless a space for housing the load collapse preventing plate 34 is formed within the container 1. Therefore, there are defects that, in the case of carrying out the solid goods 32, the load collapse preventing plate 34 must be removed each time and is inconvenient to handle. On the other hand, there is a defect that, if a space for housing the load collapse preventing plate 34 is to be formed within the container 1, a dead space will be produced within the container 1. In the above mentioned embodiment, these defects can be eliminated.

Figure 12:
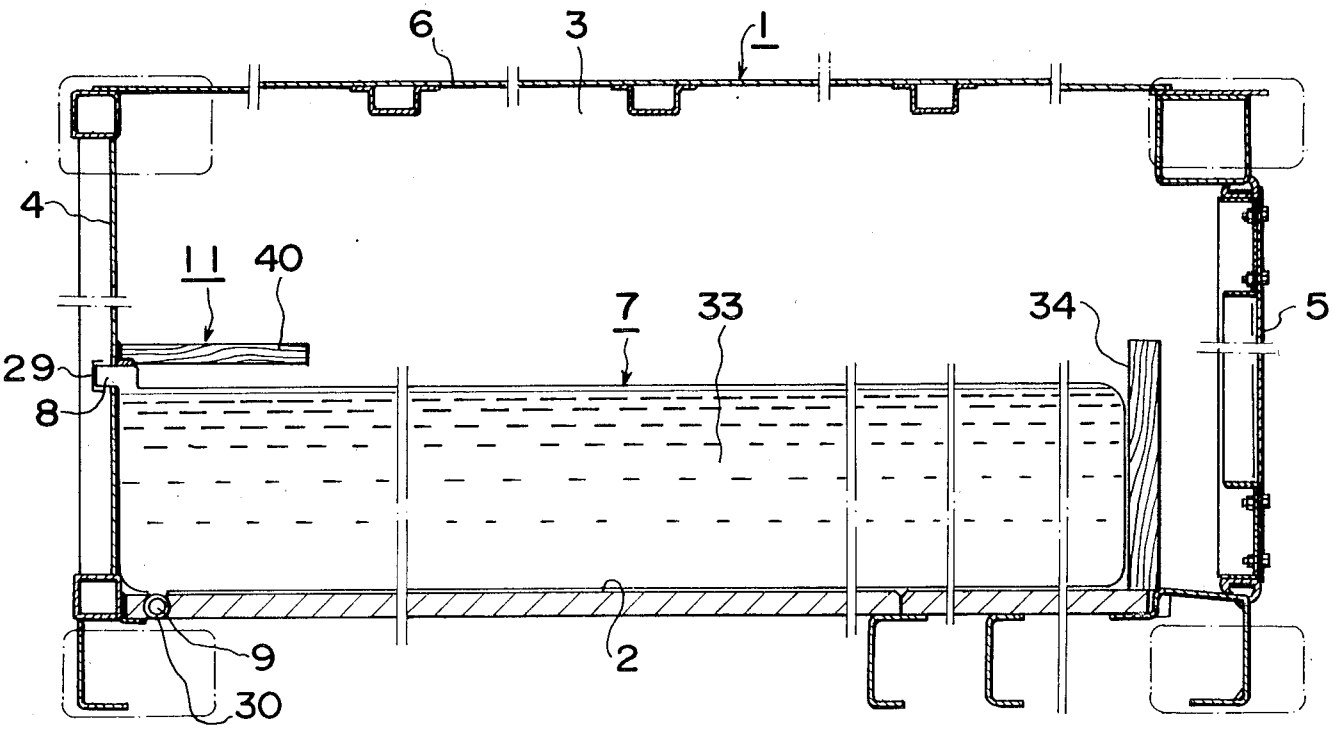
FIGS. 12 and 13 show further another embodiment.
Figure 13:
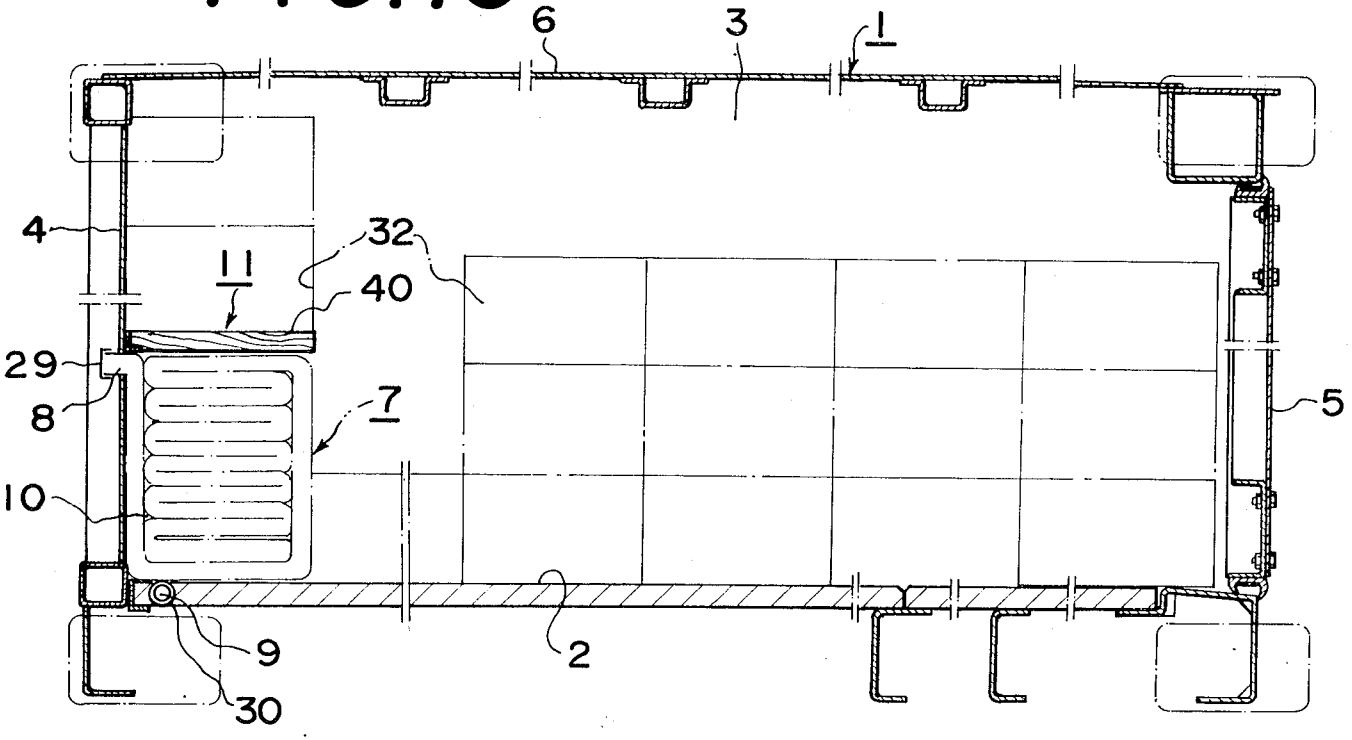

FIGS. 12 and 13 show further another embodiment. By the way, the same reference numerals are attached to the same component parts as in the above mentioned embodiment.

In this embodiment, the inlet port 8 is provided on the front end panel 4 in the position substantially opposed to the upper surface of the liquid containing bag 7 when inflated and the outlet port 9 is provided below the floor 2. By the way, the above mentioned inlet port 8 may be provided on the side panel 3. The front end panel 4 and side panels 3 shall be generally called peripheral wall panels.

The position of forming the above mentioned inlet port 8 is determined by so attending that the liquid containing bag 7 may be easy to house in the corner as folded or rolled and may not be in the way of loading the solid goods 32.

In this respect, in FIGS. 12 and 13, the inlet port 8 is provided on the front end panel 4 and, at the time of transporting the solid goods 32, as shown in FIG. 13, the liquid containing bag 7 will be housed in the corner on the front end panel 4.

By the way, in the case of providing the inlet port 8 on the side panel 3, it had better be provided on the front end panel 4 side on the side panel 3 so that the liquid containing bag 7 may be easy to house as folded or rolled.

As in the above, in this embodiment, as the inlet port 8 is provided on the peripheral wall panel 3 or 4 in the position substantially opposed to the upper surface of the liquid containing bag 7 when inflated, there are advantages that, as shown in FIG. 12, even in the case of pouring the liquid goods 33 into the bag 7 prior to the transportation, the worker need not climb onto the roof by using a ladder or footrest and may work on the ground, a quick work is possible and no pump is always required to be used to charge the bag 7 with the liquid goods. Further, there is an advantage that, as shown in FIG. 13, even in the case of containing the solid goods 32, as there is no piping to the roof panel 6, the effective space will be expanded.

Also, in the embodiment shown in FIGS. 12 and 13, the protective partition 11 is made of a plate 40 provided on the front end panel 4 so as to be positioned on the front end panel 4 side on the upper surface side of the liquid containing bag 7 when inflated. By the way, the plate 40 may be provided on the side panel 3.

Therefore, there is an advantage that the formation of the protective partition 11 is very simple.

As detailed in the above, according to the present invention, as solid or liquid goods can be transported as required, there are obtained effects that the container can be used efficiently and is economical.

We claim:

1. A solid and liquid goods transporting container characterized in that a liquid containing bag is mounted on the upper surface of the floor of a box-shaped container and is provided with an inlet port and outlet port opening outside the container and a protective partition forming a space for housing the above mentioned liquid containing bag when solid goods are to be transported is provided in the lower corner on the front end panel side of the container.

2. A solid and liquid goods transporting container according to claim 1 characterized in that said protective partition is a two-folded plate closely contactable with the inside surface of said container.

3. A solid and liquid goods transporting container according to claim 1 characterized in that said inlet port is an opening at the upper end of an inlet hose laid along a corner pillar on the front end panel side and opening on the upper outside of the box-shaped container and there is provided a hose protector covering said inlet hose, fitting rotatably at one end to the lower surface of a roof panel and having at the other end a locker engaging with a receiver provided in a proper position in the upper part within the container.

4. A solid and liquid goods transporting container according to claim 2 characterized in that said inlet port is an opening at the upper end of an inlet hose laid along a corner pillar on the front end panel side and opening on the upper outside of the box-shaped container and there is provided a hose protector covering said inlet hose, fitted rotatably at one end to the lower surface of a roof panel and having at the other end a locker engaging with a receiver provided in a proper position in the upper part within the container.

5. A solid and liquid goods transporting container according to claim 1 characterized in that a removable load collapse preventing plate is provided on the opening and closing door side on the floor.

6. A solid and liquid goods transporting container according to claim 5 characterized in that a fixing part for said load collapse preventing plate is formed in a proper position on the front end panel side within said box-shaped container and said protective partition consists of the load collapse preventing plate moved and fixed to said fixing part and a plate provided closely contactably with the inside surface of said container.

7. A solid and liquid goods transporting container according to claim 1 characterized in that said inlet port is provided on the peripheral wall panel in the position substantially opposed to the upper surface of the liquid containing bag when inflated and said outlet port is provided below the floor.

8. A solid and liquid goods transporting container according to claim 1 characterized in that said protective partition is a plate provided on the peripheral wall panel so as to be positioned on the front end panel side on the upper surface side of said liquid containing bag when inflated.

* * * * *